United States Patent [19]

Grove et al.

[11] Patent Number: 4,546,813

[45] Date of Patent: Oct. 15, 1985

[54] ADJUSTABLE INSERT FOR TWIN CASTING

[75] Inventors: John A. Grove, Franklin; John W. Grove, Seneca, both of Pa.

[73] Assignee: United States Steel Corporation, Pittsburgh, Pa.

[21] Appl. No.: 703,060

[22] Filed: Feb. 19, 1985

[51] Int. Cl.[4] ..... B22D 11/00; B22D 11/04

[52] U.S. Cl. ..... 164/420; 164/436; 164/491

[58] Field of Search ..... 164/420, 491, 436, 418, 164/483

[56] References Cited

U.S. PATENT DOCUMENTS 3,717,197 2/1973 Strack et al. ..... 164/420
4,223,717 9/1980 Scheurecker ..... 164/477
4,356,860 11/1982 Gladwin ..... 164/436 X

FOREIGN PATENT DOCUMENTS 55-97852 7/1980 Japan ..... 164/436

*Primary Examiner*—Nicholas P. Godici
*Assistant Examiner*—Kenneth F. Berg
*Attorney, Agent, or Firm*—William F. Riesmeyer

[57] ABSTRACT

An insert is provided for a continuous caster mold which permits casting of plural strands in the mold. The insert has opposed wall faces, the spacing of which is independently adjustable at their upper and lower ends. The spacing of the upper and lower ends is made adjustable by separately actuable wedge assemblies, each of which includes a wedge and ramps having mateable angularly aligned surfaces. At least one surface in each pair of adjoining wedge and ramp surfaces has a convex curvature to permit adjustment of the angular alignment of the wall faces as required at the various spacing distances thereof. The wedges provide greater rigidity than screw-type adjustment, preventing undesirable variations in taper during casting. The invention includes a method of installing the insert in the mold and adjusting the spacing and angular alignment of the opposed wall faces of the insert.

6 Claims, 5 Drawing Figures

ADJUSTABLE INSERT FOR TWIN CASTING

BACKGROUND OF THE INVENTION

This invention relates to an insert for a continuous caster mold to facilitate the casting of more than one strand in said mold, and particularly to a method and apparatus for adjusting the spacing as well as the taper of opposed wall faces of the insert.

It is known to install an insert in the cavity of a continuous caster mold to establish plural mold cavities for the casting of more than one strand in the mold. U.S. Pat. No. 3,717,197, Strack et al discloses an insert for this purpose. The reference apparatus is adjustable so as to permit tilting of opposed wall faces of the insert in opposite directions. Plates forming the wall faces are pivotally linked to the lower end of a stationary divider wall portion of the insert which in turn is connected to the wide or long sides of the mold. Changes in the spacing between each outer short side of the mold and opposed wall faces of the insert are made by adjustment of the position of the outer short sides of the mold.

There are a number of problems with such a system in which the strand width is changed solely by adjusting the position of the outer short sides of the mold. For example, where computer control is used to set the spacing of mold walls it is desirable to have the opposed wall faces of the insert always set at the same spaced locations in order to get the same slab width from measured readings of mold short side wall positions. Since the opposed faces of the insert wear and may be repaired by face-off machining, the actual spacing would vary each time a new or repaired insert is installed. Another reason that it is desirable to set opposed wall faces of the insert at the same spacing is the need for positioning them at the same location with respect to worn spots on the longer sides of the mold each time the insert is installed in the mold. Failure to set the opposed wall faces of the insert at the same location with respect to the broad faces of the mold results in the formation of poorly-shaped corners on the slabs being cast. U.S. Pat. No. 4,223,717, Scheinecker shows a typical pattern of wear on the mold wall faces. Finally, it is desirable to be able to set the opposed wall faces of the insert at the same position so as to obtain a good seal between the mold and starter bar at the beginning of casting.

The Strack et al patent discloses that a wedge may be used as an alternative to screws for spreading the upper ends of the wall faces to change their angular alignment. The use of wedges at both the upper and lower ends would normally permit adjustment of the wall spacing, but not their angular alignment. I have found that provision can be made for adjustment of angular alignment as well as spacing utilizing upper and lower wedges and that the use of such wedges provides a more rigid structure due to contact of the wedges along a horizontal line with the mateable surfaces of ramps adjoining each wedge instead of the more limited "point" contact area when screws are used. The improved rigidity prevents variation in the set taper from occurring during casting, except as desired, decreasing the possibility of breakouts which may be caused thereby.

It is, therefore, a primary object of the invention to provide a method of installing an insert in a continuous caster mold, said insert having apparatus for adjusting the spacing as well as the angular alignment of opposed wall faces thereof, said apparatus providing increased rigidity so that the desired angular alignment of the wall faces is maintained during casting.

SUMMARY OF THE INVENTION

The invention relates to an insert for use in a continuous caster mold, said mold having opposed pairs of broad and narrow mold walls. The insert is adapted to be mounted in position between opposed broad walls of the mold to facilitate the casting of more than one strand in the mold. The insert has opposed wall faces of width mateable with the opposed narrow walls of the mold, said opposed wall faces being aligned in position facing the narrow mold walls. The insert includes means for adjusting the taper or angular alignment of its opposed wall faces with respect to a direction in which metal is cast through the mold. In the improvement of this invention, the insert includes a plate member centrally located between opposed wall faces of the inset and aligned generally parallel to the insert wall faces. The plate member is adapted to be attached to the broad mold walls. The plate member has a pair of slots extending through it to openings facing the insert wall faces. The slots are located at spaced positions adjacent opposed ends of the insert wall faces in the casting direction. A pair of wedges are mounted in the slots in the plate member and are slidably movable in said slots in the casting direction. Each wedge has a first pair of opposed pressure contact surfaces facing the insert wall faces and angularly aligned with respect to the direction of casting. The first pair of pressure contact surfaces are inclined at opposed equal angles with respect to the casting direction. A first pair of ramps is secured to the insert wall faces. Each of the first pair of ramps has a pressure contact surface mateably aligned with respect to one of the first pair of opposed wedge pressure contact surfaces and is located adjacent to said surface for making sliding contact with it. At least one surface in each adjoining pair of wedge and first pair of ramp pressure contact surfaces has a convex curvature, the curvature being sufficient to permit adjustment of the angular alignment or tilting of the opposed wall faces as required at the various spacing distances of the wedges in said slots. Means is provided for tiltably connecting the inset wall faces to the plate member. Also, means is provided for independent actuation of the wedge in each slot in order to move it slidably in the casting direction, in order to vary the spacing distance of the wedges in said slots, thereby adjusting both the spacing and angular alignment of the insert wall faces. A method is also provided for installing said insert into a continuous caster mold to enable casting plural strands in the mold.

DESCRIPTION OF THE PREFERRED EMBODIMENT

Figure 3:
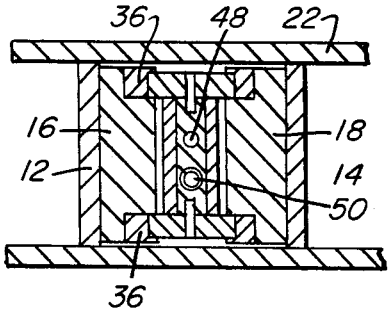
FIG. 3 is a section taken at III—III of FIG. 1.
Figure 1:
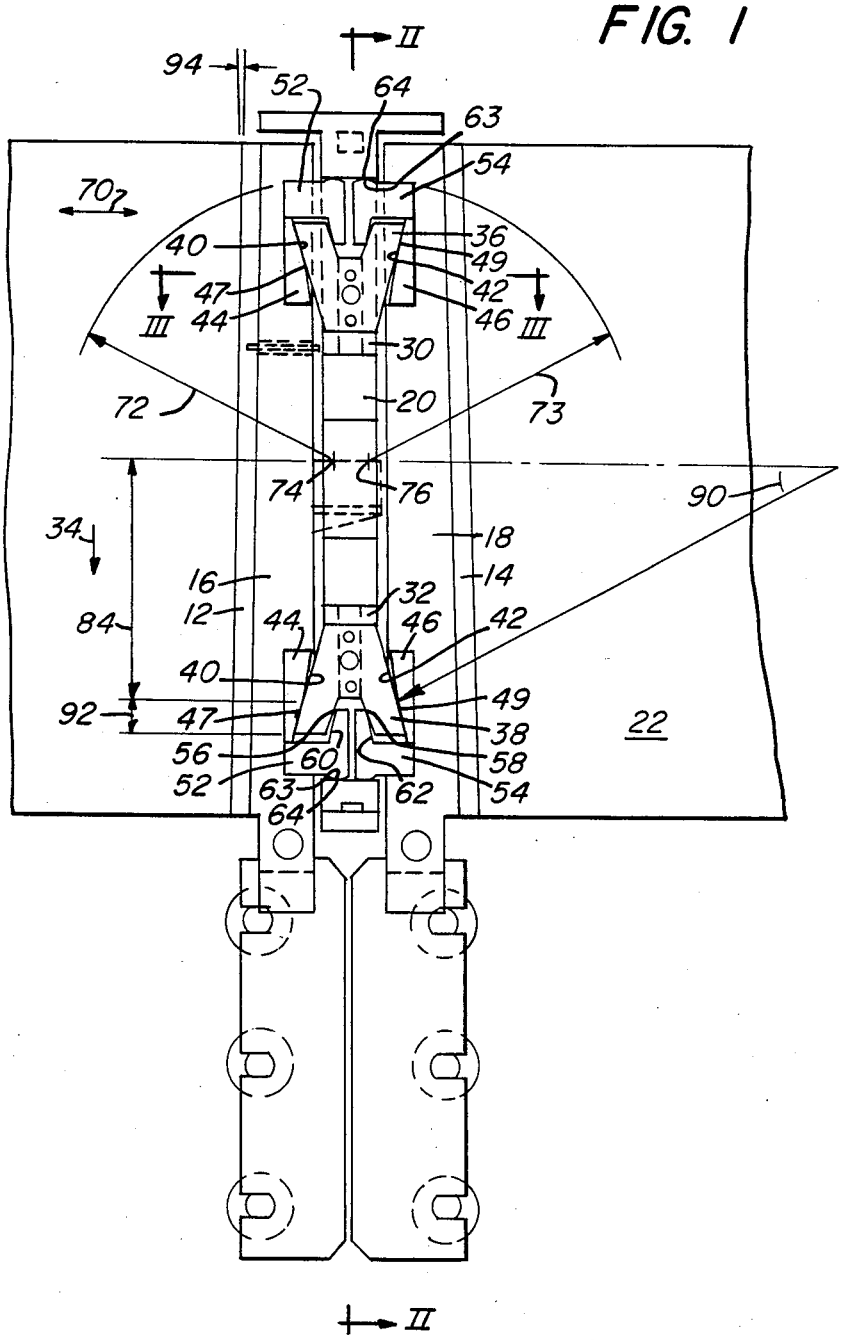
FIG. 1 is a side elevation view of the improved insert of this invention, as installed in a continuous caster mold.
Figure 2:
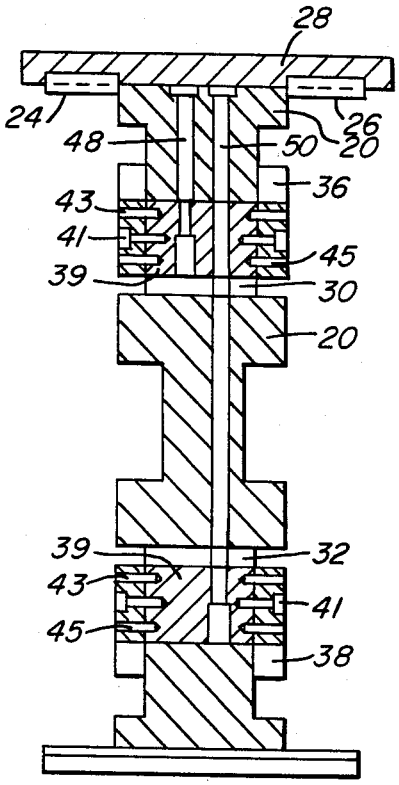
FIG. 2 is a section taken at II—II of FIG. 1.

Referring to FIG. 1 an insert of conventional type such as disclosed in U.S. Pat. No. 3,737,197 includes two opposed tiltable wall face assemblies. The wall face assemblies are generally comprised of copper alloy wear plates 12, 14 attached to steel support plates 16, 18. The improvement of this invention includes a plate member 20 centrally located between the opposed wall face assemblies and generally in parallel alignment with respect thereto. The plate member is adapted for attachment to the broad walls of the caster mold, one of which is illustrated at 22 in FIG. 1. Such attachment can be accomplished for example by insertion of keys 24 and 26 (FIG. 2) in keyway slots located in a retaining plate 28 secured to plate member 20. The keys also fit in mateable keyway slots (not shown) provided in the top surface of the broad mold walls. The plate member has a pair of slots 30, 32 located at spaced positions adjacent opposed ends of the insert wall faces in the direction of casting 34. A pair of wedges 36, 38 are mounted in the slots so as to be slidably movable in the slots in the casting direction. Each wedge has a first pair of pressure contact surfaces 40, 42 inclined at opposed equal angles with respect to the casting direction. Preferably the angle of inclination of the first pair of pressure contact surfaces of each wedge is equal to the angle of inclination of the corresponding first pair of the opposed pressure contact surfaces of the other wedge. A first pair of ramps 44, 46 are secured to the steel support plates 16, 18 adjacent to the first pair of pressure contact surfaces of each wedge. The ramps have surfaces 47, 49 generally of mateable alignment with said first pair of opposed pressure contact surface of each wedge. At least one surface in each of the aforementioned wedge and ramp pressure contact surfaces has a convex curvature sufficient to permit tilting of the insert wall faces as described below. In the embodiment shown, ramp pressure contact surfaces have a convex curvature and the wedge surfaces are planar. This might be reversed so that the ramp surfaces are planar and the wedge surfaces convex, or both might have a convex curvature. Means are provided for independent actuation of each wedge to move the wedges slidably in the slots in the plate member. For example, spindles 48, 50 are threaded at their lower ends so as to threadedly engage a threaded bore in each wedge. The spindles are separately actuable for causing movement of each wedge independently of the other.

Means is also provided for tiltably connecting the insert wall faces to the plate member. Such tiltable connection might be accomplished by tiltably connecting the opposed wall faces to each other or by tiltably connecting them directly to the plate member. For example, the opposed wall faces may be tiltably connected to the plate member at locations adjacent their opposed ends in the casting direction as shown in FIG. 1. The tiltable connecting means shown includes a second pair of ramps 52, 54 associated with each wedge, the ramps being secured to the steel support plates 16, 18, respectively. These ramps have pressure contact surfaces 56, 58 generally of mateable alignment with respect to a second pair of opposed pressure contact surfaces 60, 62 of each wedge. Again, at least one surface in each adjoining pair of these latter wedge and ramp pressure contact surfaces 56, 60 and 58, 62 has a convex curvature sufficient to permit tilting of the insert wall faces as required at the various spacing distances of the wedges. In the embodiment shown the pressure contact surfaces 56, 58 of the ramps have a convex curvature while the wedge surfaces are planar. As mentioned previously, both of the contact surfaces in each adjoining pair would have a convex curvature although this is not preferred. The second pair of ramps and the plate member also have adjoining pressure contact surfaces 63, 64 which are aligned in a generally normal direction at a right angle with respect to the casting direction. Pressure contact surface 63 of each ramp also has a convex curvature sufficient to permit tilting as required.

Figure 4:
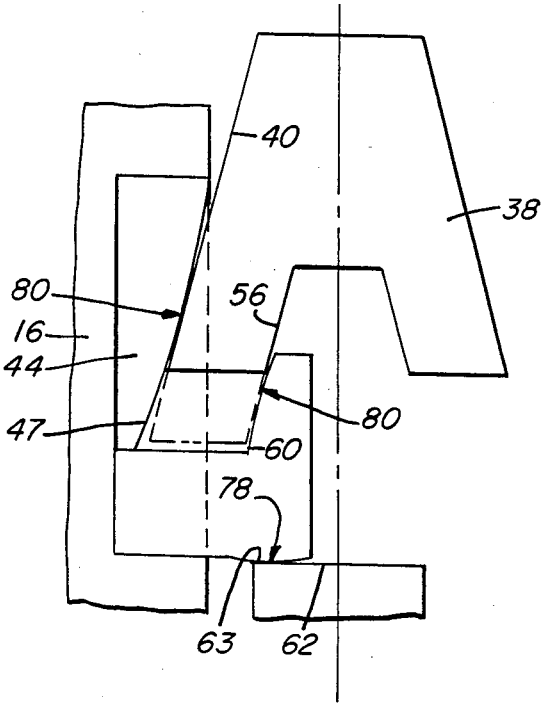
FIG. 4 is a schematic illustration of one of the wedges and the associated ramp surfaces on a larger scale.
Figure 5:
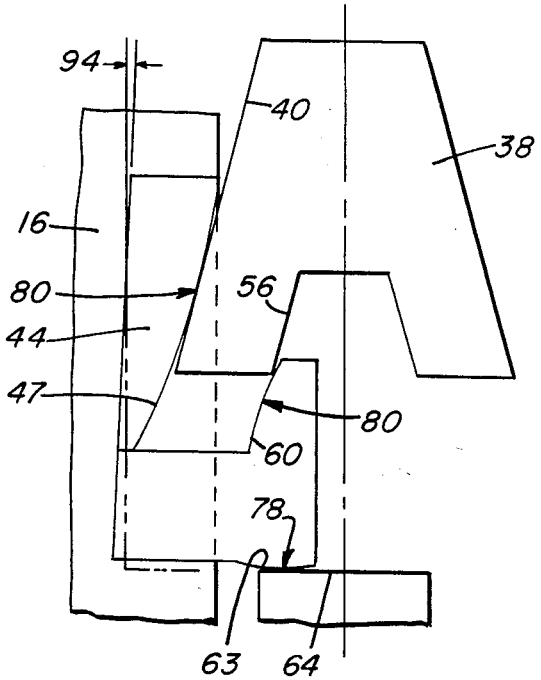
FIG. 5 is a schematic illustration of one of the wedges and associated ramp surfaces in different positions than shown in FIG. 4.

The upward and downward motion of the wedges in FIG. 1 cause both a sliding and rotating motion of the opposed wall faces of the insert. The insert wall faces slide inwardly and outwardly in a horizontal direction 70 and also rotate in a circular motion on arcs formed by equal radii 72, 73 about axes 74, 76, respectively. The insert wall faces slide to positions having a vertical alignment with respect to FIG. 1 when the wedges are adjusted so as to be equally spaced from the axes 74, 76. Movement of one of the wedges to a different spacing from those axes causes tilting of the insert wall faces. The radius of curvature 78 (FIGS. 4 and 5) of each contact surface 63 should be substantially equal to radii 72 and 73 in FIG. 1 in order to permit tilting in the circular motion just mentioned. The radii of curvature of ramp surfaces 47, 49 and 60, 62 are all substantially equal with the exception of greater clearance provided in surfaces 60, 62. These latter four radii designated 80 in FIGS. 4 and 5 have a value within a range defined by the following relationships:

R minimum $= c/\sin\theta$ where c is the distance 84 from the axes 74, 76 to the line of pressure contact of the adjoining first pair of ramp and wedge surfaces and $\theta$ is the ramp pressure angle 90 with respect to the horizontal direction in FIG. 1.

R maximum $= D/\sin\alpha$ where D is the distance 92 from the line of pressure contact of the first pair of ramp and wedge pressure contact surfaces to the outermost extent of the wedge and $\alpha$ is the maximum angular rotation 94 of the opposed wall faces of the insert.

In using the insert of this invention, the insert is installed in the caster mold with its opposed wall faces aligned facing the narrow outer faces of the mold. The insert is secured to the mold by insertion of keys 24 and 26 in the slots provided in retaining plate 28. Then the spacing of the upper and lower ends of the opposed wall faces are separately adjusted so as to locate the upper and lower ends at a predetermined location with respect to broad mold walls, for example, at the same location as the opposed wall faces of an insert previously used in the mold. Preferably the spacing is set so as to position the insert wall faces at the location of worn spots on the broad walls of the caster mold. Such worn spots are disclosed in U.S. Pat. No. 4,223,717, the specification of which is incorporated herein by reference. After adjustment of the spacing, the angular alignment of the opposed wall faces is adjusted by making minor corrections in the spacing of the upper or lower ends of the said opposed wall faces, or both of them. Preferably, the lower ends are adjusted to make the correction necessary for obtaining the desired angular alignment.

We claim:

1. In an insert for a continuous caster mold, said mold having opposed pairs of broad and narrow mold walls, said insert being adapted for mounting between the broad mold walls in order to facilitate the casting of plural strands in the mold, said insert having opposed wall faces aligned facing the narrow mold walls, said insert having means for adjusting the angular alignment of said opposed wall faces with respect to a direction in which metal is cast through the mold, the improvement in said insert for adjusting the spacing as well as the angular alignment of said exposed wall faces which comprises:

a plate member centrally located between said opposed wall faces and aligned generally parallel thereto, said plate member being adapted for attachment to the broad mold walls, said plate member having a pair of slots extending through said plate member to openings facing toward the opposed wall faces, said slots being located at spaced positions adjacent opposed ends of the insert wall faces in the casting direction, a pair of wedges mounted in the slot so as to be slidably movable in said slots in the casting direction, said wedges having a first pair of opposed pressure contact surfaces facing the insert wall faces, said pair of opposed pressure contact surfaces being inclined at opposed equal angles with respect to the casting direction, a first pair of ramps secured to the insert wall faces adjacent to the first pair of opposed pressure contact surfaces of said wedge, said pair of ramps each having a pressure contact surface mateably aligned with respect to one of said first pair of pressure contact surfaces of said wedge, at least one pressure contact surface in each adjoining pair of wedge and first pair of ramp pressure contact surfaces having a convex curvature sufficient to permit tilting of said insert wall faces with respect to the plate member at the various spacing distances of the wedges in said slots, means for tiltably connecting the insert wall faces to the plate member, and means for independent actuation of the wedge in each slot in order to slidably move said wedge in the casting direction and adjust the distance of spacing between the wedges in said slots, thereby adjusting the spacing and angular alignment of the insert wall faces.

2. The improved insert of claim 1 wherein the angle of inclination of the opposed pressure contact surfaces of a first of said wedges is an acute angle with respect to the casting direction and the angle of inclination of the opposed pressure contact surfaces of a second of the wedges is an obtuse angle with respect to the casting direction, and wherein said angle of inclination of the opposed surfaces of the first and second wedges is equal.

3. The improved insert of claim 1 wherein said tiltable connecting means includes a second pair of ramps associated with each wedge, said wedge having a second pair of opposed pressure contact surfaces inclined at substantially the same angle as the first pair of pressure contact surfaces of said wedge with respect to the casting direction, said second pair of ramps being secured to one of the insert wall faces and having pressure contact surfaces generally mateably aligned with respect to the second pair of opposed pressure contact surfaces of said wedge, at least one surface in each adjoining wedge and second pair of ramp pressure contact surfaces having a convex curvature sufficient to permit tilting of the insert wall faces with respect to the plate member at the various spacing distances of the wedges in said slots, said second pair of ramps and the plate member having adjoining pressure contact surfaces aligned in a generally normal direction with respect to the casting direction, the latter mentioned pressure contact surface of said ramp also having curvature sufficient to permit said tilting of the insert wall faces with respect to said plate member.

4. The improved insert of claim 2 wherein said first wedge is located ahead of the second wedge in the casting direction.

5. A method of installing an insert in a continuous caster mold so as to enable the casting of plural strands in the mold, said mold having opposed pairs of broad and narrow mold walls, said insert having opposed wall faces of width mateable with the narrow wall of the mold, said opposed wall faces having an outer surface adapted for contact by molten metal in the mold, said method comprising:

(a) placing said insert in the mold between the opposed broad mold walls so that the opposed wall faces are aligned facing toward the narrow mold walls, (b) adjusting the spacing between a first end of said opposed wall faces with respect to a direction of casting metal through the mold so that the outer surfaces of said first end of the opposed wall faces is positioned at a first predetermined location with respect to the broad mold walls, (c) separately adjusting the spacing between a second end of said opposed wall faces with respect to the casting direction so that the outer surface of said second end of the opposed wall faces is positioned at a second predetermined location with respect to the broad mold walls, (d) then making minor corrections in the spacing of the first and second ends of said opposed wall faces so as to correct the angular alignment of said opposed wall faces.

6. The method of claim 5 wherein steps (b) and (c) include adjusting the spacing of the opposed ends of said insert wall faces so as to position the outer surfaces thereof substantially at the location of a worn spot on the broad mold walls.

* * * * *